US005806248A

United States Patent [19]

Kim

[11] Patent Number: 5,806,248

[45] Date of Patent: Sep. 15, 1998

[54] MULTI-PURPOSE QUARTERS HAVING A SLIDABLE COVER WITH A PULL-DOWN BED

[76] Inventor: Sung Yoon Kim, 2138, Daehwa-dong, Koyang-city, Kyunggiu-do, 411-410, Rep. of Korea

[21] Appl. No.: 849,622

[22] PCT Filed: Dec. 15, 1995

[86] PCT No.: PCT/KR95/00163

§ 371 Date: Jun. 4, 1997

§ 102(e) Date: Jun. 4, 1997

[87] PCT Pub. No.: WO96/18785

PCT Pub. Date: Jun. 20, 1996

[30] Foreign Application Priority Data

Dec. 15, 1994 [KR] Rep. of Korea ..... 1994-34198

[51] Int. Cl.[6] ..... A47B 83/00; A47B 83/04; E04H 1/12

[52] U.S. Cl. ..... 52/36.1; 5/2.1; 52/79.5; 312/194

[58] Field of Search ..... 5/2.1, 133, 159.1; 312/194, 237; 52/36.1, 67, 79.5

[56] References Cited

U.S. PATENT DOCUMENTS

| | | | |
|---|---|---|---|
| 2,673,132 | 3/1954 | Alderman | 52/36.1 |
| 4,594,817 | 6/1986 | McLaren et al. | 5/2.1 |
| 4,694,518 | 9/1987 | Lukich et al. | 5/2.1 |

FOREIGN PATENT DOCUMENTS

| | | |
|---|---|---|
| 2616638 | 12/1988 | France . |
| 1297312 | 6/1969 | Germany . |
| 3503989 | 8/1986 | Germany . |
| 919508 | 6/1991 | Rep. of Korea . |

*Primary Examiner*—Alexander Grosz
*Attorney, Agent, or Firm*—Ladas & Parry

[57] ABSTRACT

A multi-purpose quarters (MPQ) enclosing a reading space with walls in order to enhance the reader's concentration. The MPQ is provided with a desk, a computer panel, bookracks and a bed. The MPQ has a box-shaped body and cover slidable relative to each other for movement between an open position in which the body and the cover are spaced from one another and form the reading space, and a closed position in which the body is enclosed within the cover. A pull-down bed is provided on the cover and forms a front wall of the cover when the MPQ is closed. The body has a vertically movable holding panel and an inclined desk which is vertically movable with the holding panel by a drive motor. The holding panel moves vertically within the body under the guidance of a plurality of channeled columns extending vertically at the corners of the body.

23 Claims, 9 Drawing Sheets

FIG.7
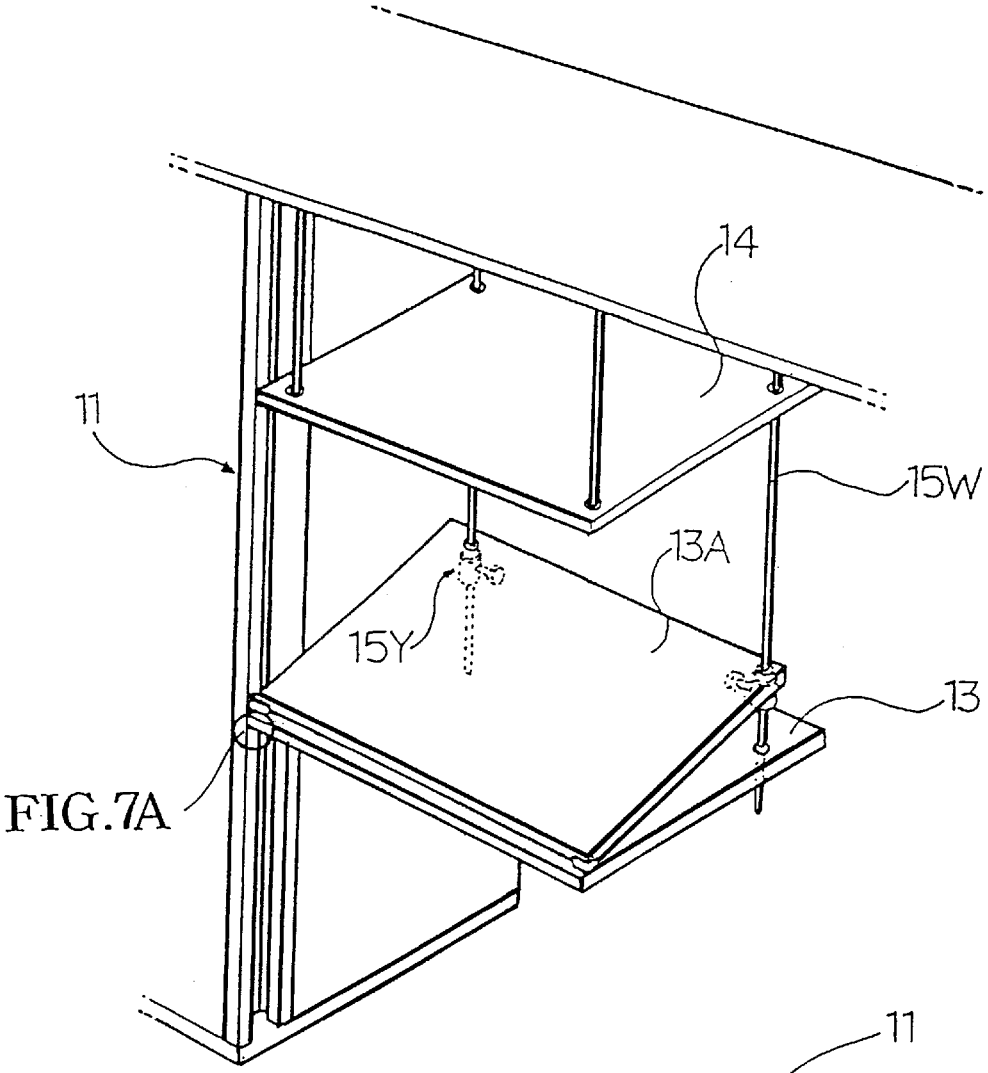
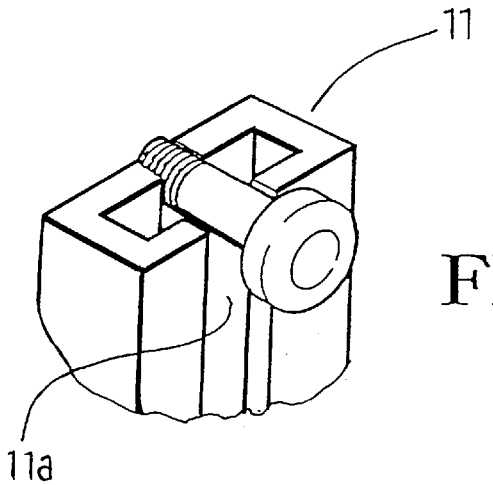
FIG.7A

MULTI-PURPOSE QUARTERS HAVING A SLIDABLE COVER WITH A PULL-DOWN BED

FIELD OF THE INVENTION

The present invention relates in general to a multi-purpose study room/bedroom referred to hereafter as a Multi-Purpose Quarters, (MPQ), which is a compact version of a room consisting of a bed, desk and computer table whereby space is minimized and concentration is maximized. The MPQ comprises a box-like structure which when opened, acts as an individual study room, which doubles as a private computer room, where noise and distractions are isolated. The front wall of the box-like structure holds a pull-down bed which can be used when the box-like structure is closed or open. Furthermore, the MPQ is provided with left and right-handed bookracks. When not in use, the MPQ slidably retracts to its original shape to maximize the space remaining in the room.

BACKGROUND ART

Most people prefer to enclose their study area with walls in order to facilitate study and concentration. Korean U.M. Application No. 91-9508 of this applicant discloses an example of a box-like personal study room consisting of a desk, chair and bookshelves. However, this personal study room does not accommodate the other essential components of a room, mainly a computer table or a bed, which remain in the room.

SUMMARY OF THE INVENTION

An object of the present invention is to provide a structurally improved MPQ in which the above problems associated with the known personal study room are overcome and which encloses the reading space with walls in order to facilitate study and concentration and which is provided with a desk, computer table, bookracks and bed.

In order to accomplish the above object, the MPQ provides an enclosed area comprising a box-shaped body and a cover which are slidably engaged and relatively movable between an open position in which the body is spaced from the cover to form a work space therebetween, and a closed position in which the body is enclosed within the cover. The body is provided with left and right-hand bookracks. The body also includes a vertically movable holding panel and an inclined desk panel which vertically move by the rotating force of a drive motor through front and rear lifting wires. The drive motor is placed in a top section inside the body, while the lifting wires extend from opposite output shafts of the drive motor and are connected to the panels. The holding panel vertically moves in the body under the guidance of a plurality of channeled columns extending vertically at the corners of the body.

BRIEF DESCRIPTION OF DRAWINGS

The above and other objects, features and advantages of the present invention will be more clearly understood from the following detailed description taken in conjunction with the accompanying drawings, in which:

FIG. 7 is a perspective view showing the structure for lifting and inclining the panels of the MPQ of the present invention;

FIG. 7A is an enlarged detail of the structure in FIG. 7:

DETAILED DESCRIPTION OF THE INVENTION

Figure 2A:
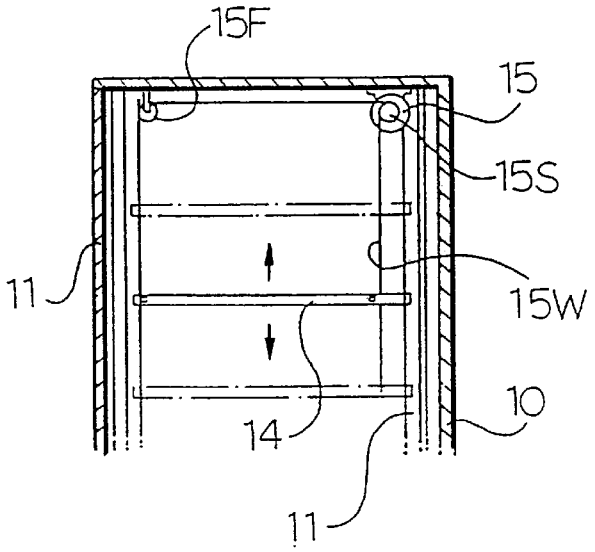
FIGS. 2A and 2B are side and plan views of the body, respectively, of the MPQ according to the present invention showing a mechanism for lifting a computer holding panel in the body.
Figure 2B:
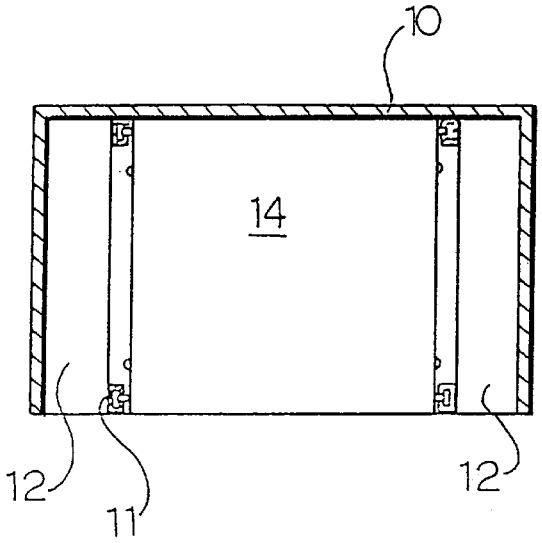
Figure 2C:
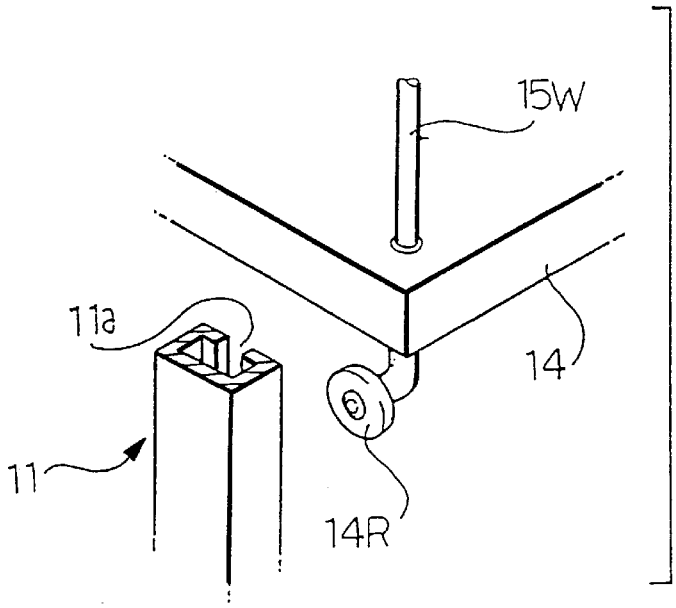
FIG. 2C is an exploded perspective view showing the structure for bringing the channeled column and holding panel of the above body in slidable engagement.
Figure 3:
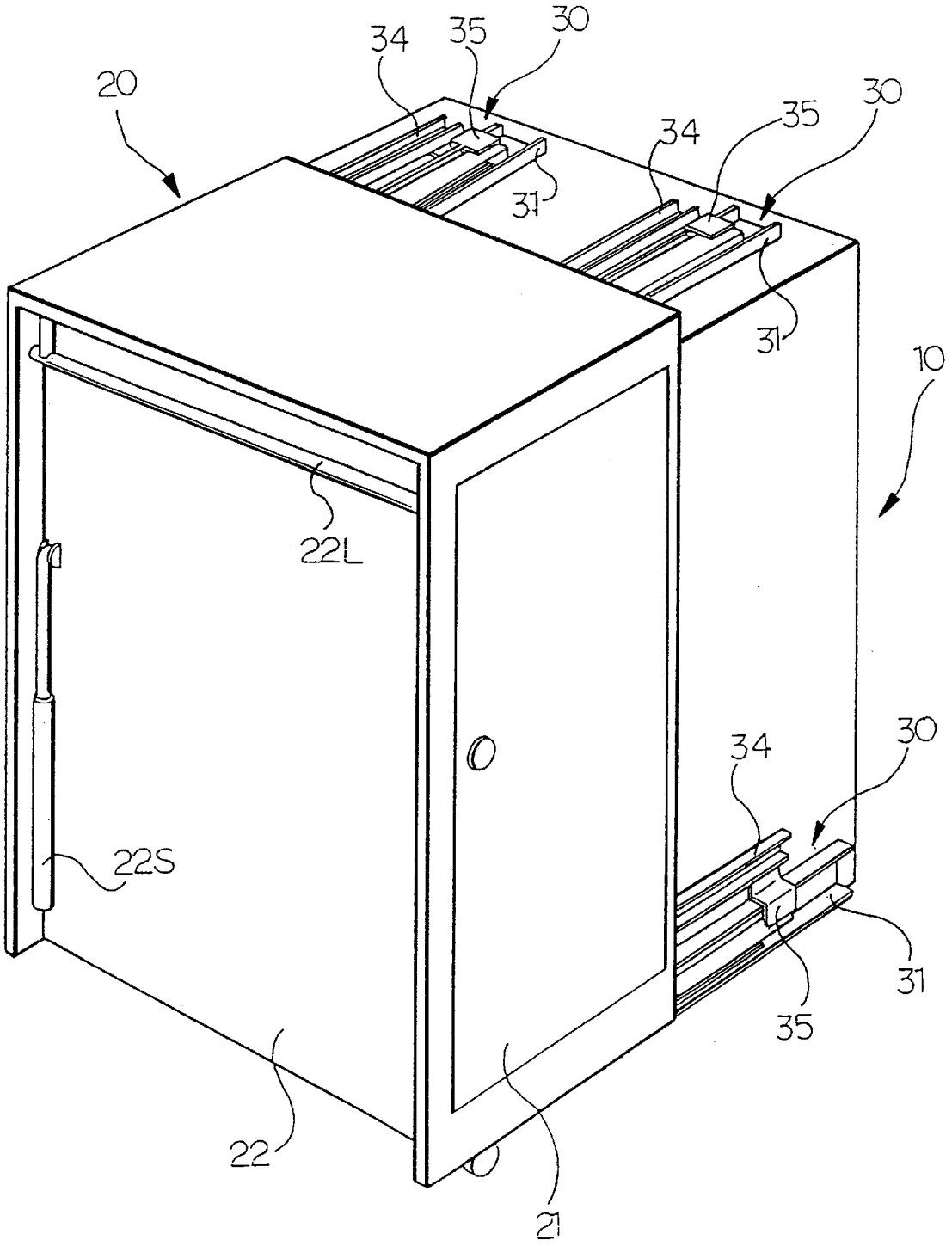
FIG. 3 is a perspective view of the MPQ of the present invention when it is used as a reading room.

The Multi-purpose Quarters, according to the primary embodiment of the present invention, includes a box-shaped body 10 which is opened forward. The body 10 has a plurality of channeled columns 11 (FIG. 2). The columns 11 extend vertically in the body 10 in spaced, parallel relation at both side walls of the body 10 as best seen in FIG. 2B. Channels 11*a* in the columns 11 are directed inwardly (FIG. 2C). Horizontally arranged in spaces defined between the columns 11 and the side walls of the body 10 are a plurality of vertically spaced shelves 12 forming bookracks. The body 10 also includes a horizontal desk panel 13 (FIG. 7) which is vertically movable in the body 10 in order to adjust its height. A front edge of an inclined desk panel 13A is hinged to the front edge of the vertically movable horizontal panel 13 as best seen in FIG. 7. (It can also remain loose). The inclined desk panel 13A is thus vertically movable along with the horizontal panel 13 in the body 10 and it is adjustable in inclination relative to the horizontal panel 13. The body 10 further includes a vertically movable holding panel 14 which is horizontally placed above the inclined panel 13A and is used for holding a computer and peripheral equipment thereon. The vertical movement of the holding panel 14 may be automatically performed by an additional lifting means which is started by a control switch (not shown). An example of the lifting means for vertically moving the panel 14 is shown in FIG. 2A and includes a drive motor 15 which is horizontally placed in the rear top corner in the body 10. A pair of shafts 15S horizontally extend from both ends of the motor 15. A pair of lifting wires 15W extend from each shaft 15S.

One lifting wire i.e. a front wire 15W extending from each shaft 15S passes over a roller 15F prior to being connected to one front corner of the holding panel 14. A roller 15F is mounted at each front corner inside the body 10. Meanwhile, the other lifting wire i.e. a rear wire 15W extends vertically down from each shaft 15S and is connected to a rear corner of the holding panel 14. As shown in FIG. 2C, a guide roller 14R is mounted at each bottom corner of the holding panel 14. The guide rollers 14R of the panel 14 are movably received in the channels 11*a* of the columns 11 respectively, thereby being guided by the columns 11 during the vertical movement of the panel 14 in the body 10.

Figure 1:
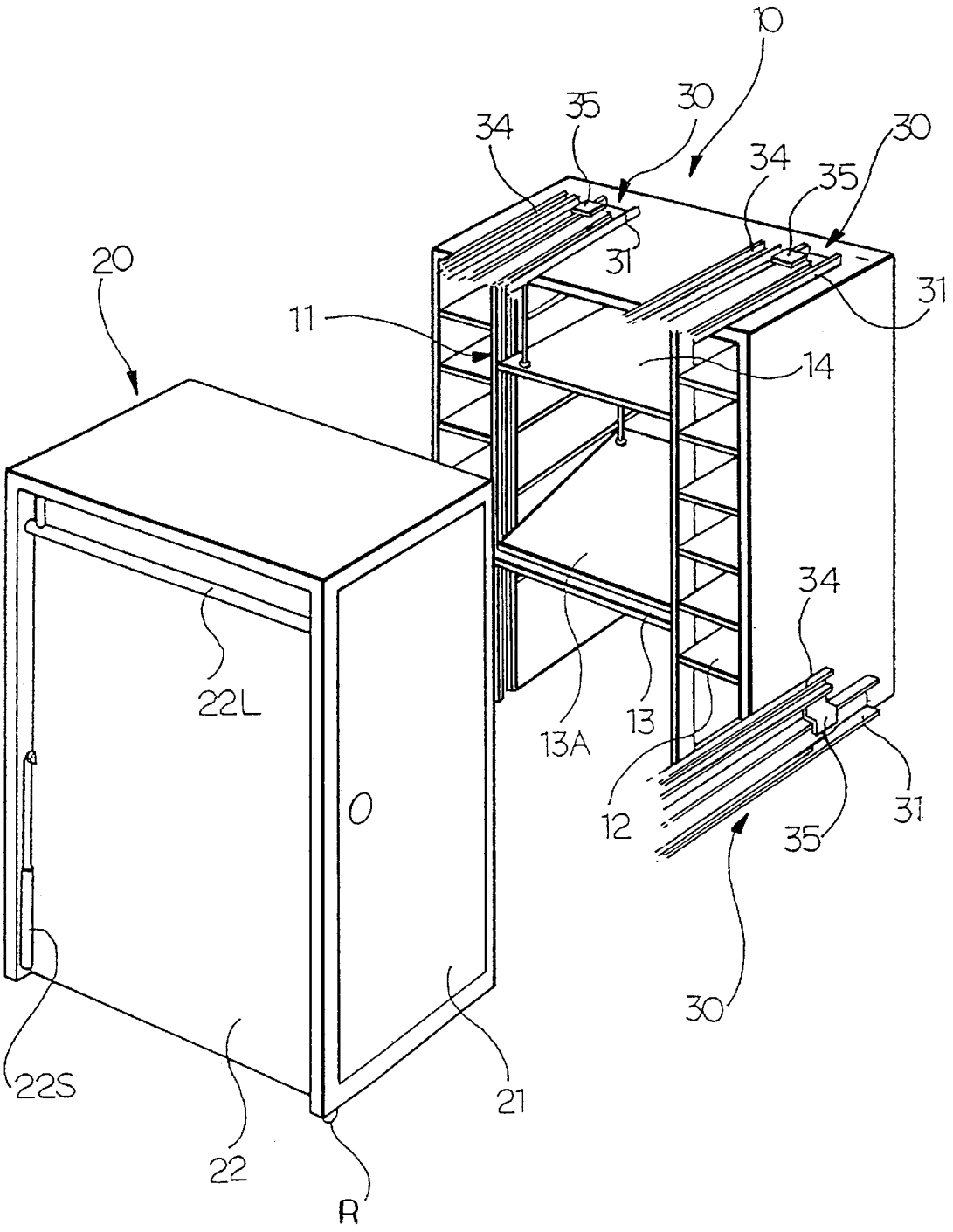
FIG. 1 is an exploded perspective view of an MPQ in accordance with a primary embodiment of the present invention, showing the slidable cover and body separated from each other.
Figure 5:
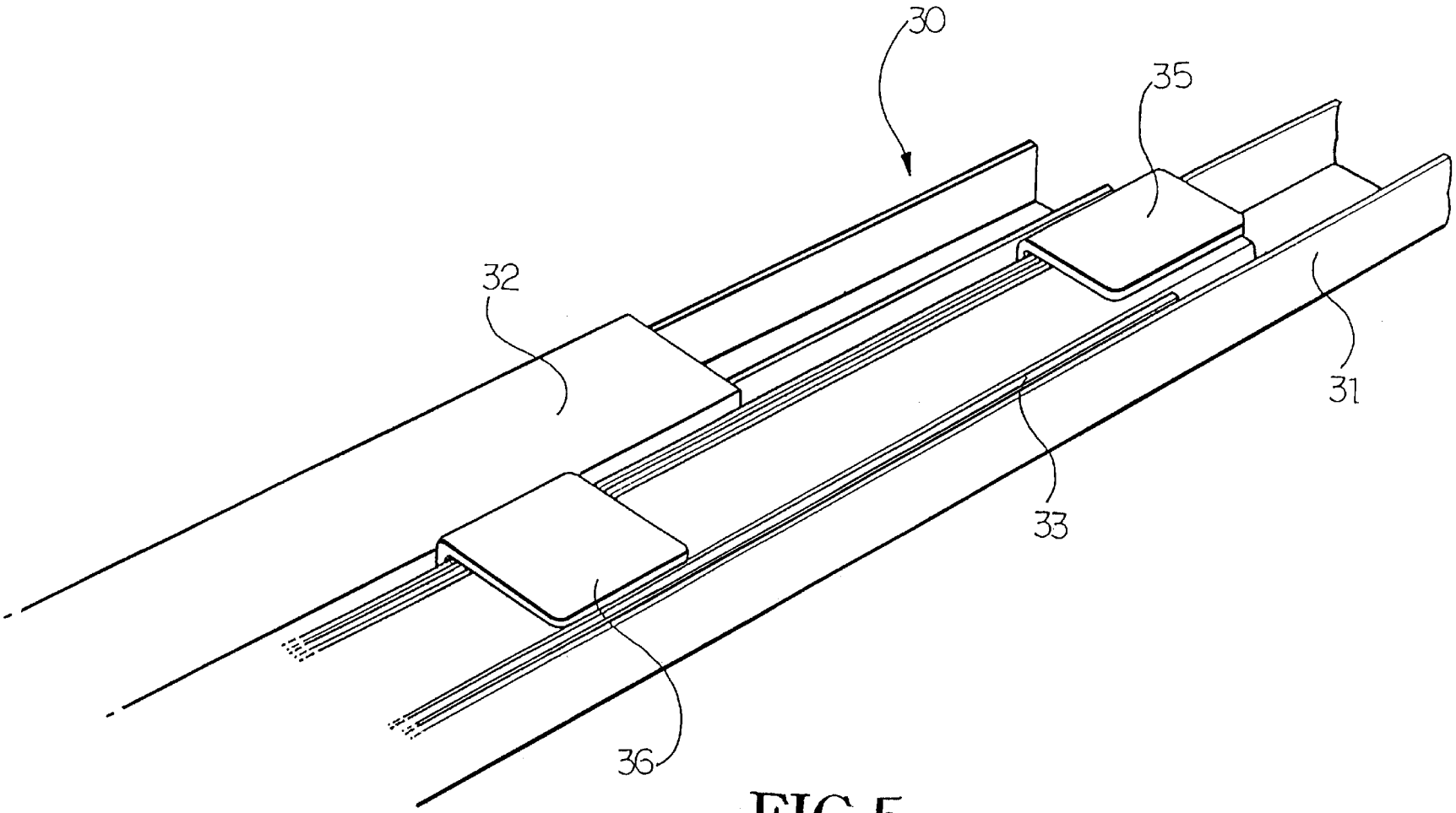
FIG. 5 is an enlarged perspective view showing a slider unit which allows the two parts of the body to open and close.

A box-shaped cover 20 slidably engages the body 10 and the body 10 and cover 20 are relatively movable towards and away from one another between an open position in which the body 10 is spaced from the cover 20 as shown in FIG. 1 and a closed position in which body 10 is enclosed within the cover 20 as shown in FIGS. 2A and 2B. In order to achieve the slidable engagement of the body 10 with the cover 20, slider units 30 are provided at the top plate and the lower portions of both side plates of the body 10, (FIG. 5). In the present invention, the sliding motion of the cover 20 relative to the body 10 using the slider units 30 may be either manually or automatically achieved. The automatic operation for sliding the cover 20 relative to the body 10 will be achieved by a drive means (not shown). Each slider unit 30 comprises a first longitudinal channeled guide 31 mounted on the body 10 and a second longitudinal channeled guide 32 mounted on the cover 20 in correspondence with the first guide 31 as shown in FIG. 5. Each slider unit 30 also includes a retainer 33 which allows the cover 20 to slide on the body 10. The retainer 33 includes a plurality of bearings which engage the first and second guides 31 and 32 to provide the sliding motion of the cover 20 on the body 10. Each slider unit 30 further includes longitudinal supports 34 which are fixed to the retainer 33 by a pair of connectors 35 and 36. The supports 34 are received in the channels of the first and second guides 31 and 32 respectively, thereby supporting the retainer 33.

An openable door 21 is mounted on each side of the cover 20 to form openable side walls for cover 20, while an openable bed 22 is pivoted to the cover 20 to form an openable front wall of the cover 20. Both the openable doors 21 and the openable bed 22 enclose the body 10 when the MPQ is in closed state. The bed 22, which is pivoted to the cover 20, has a folding front support 22L and a pair of gas springs 22S. Each gas spring 22S extends from each pivot joint between the bed 22 and the cover 20 to the bottom of the bed 22. Of course, it should be understood that the folding motion of the bed 22 may be achieved by a typical motor-driven mechanism instead of the above gas springs 22S.

Figure 4:
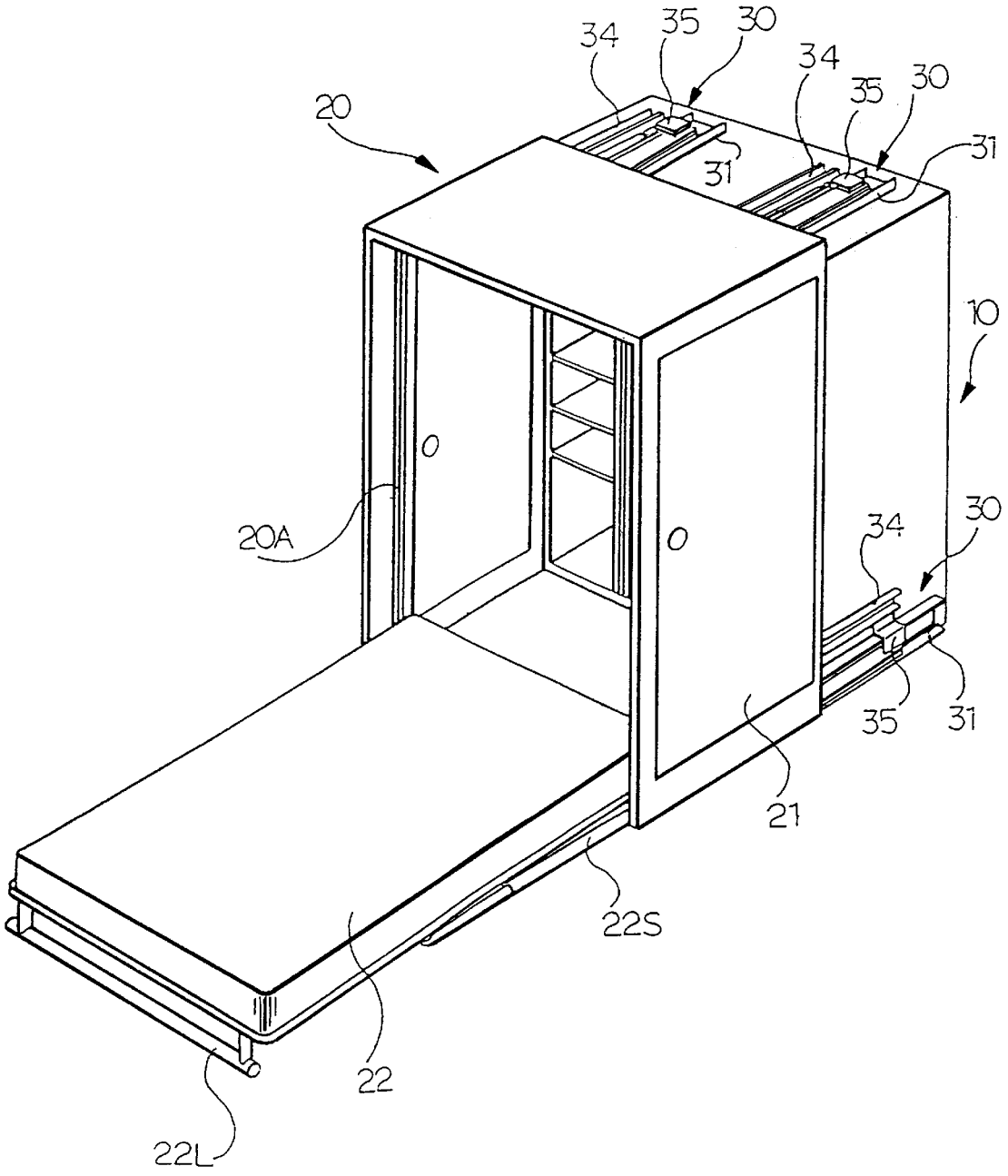
FIG. 4 is a perspective view of the MPQ of the present invention when it is used as a bed.

In the present invention, the body 10 and cover 20 are preferably provided with sound-absorbing and sound-intercepting materials. The cover 20 is also provided with elongated soundproofing members 20A (FIG. 4) mounted on the cover 20 where the cover 20 meets the edges of the bed 22 thereby absorbing external sound that would otherwise infiltrate into the MPQ through the gaps between the cover 20 and the bed 22. In addition, it is preferable to mount a handle (not shown) on a given portion of the cover 20 for slidably moving the cover 20 relative to the body 10. A roller R (FIG. 6) is mounted on each front bottom corner of the cover 20 in order to allow the cover 20 to perform a smooth sliding motion relative to the body 10. After fully separating the cover 20 from the body 10, the user opens a side door 21 and enters the MPQ, for example, to read a book on the desk panels 13 and 13A. In this case, the user is isolated from the rest of the room and the MPQ is used as a reading room in which study and concentration are facilitated.

Figure 6:
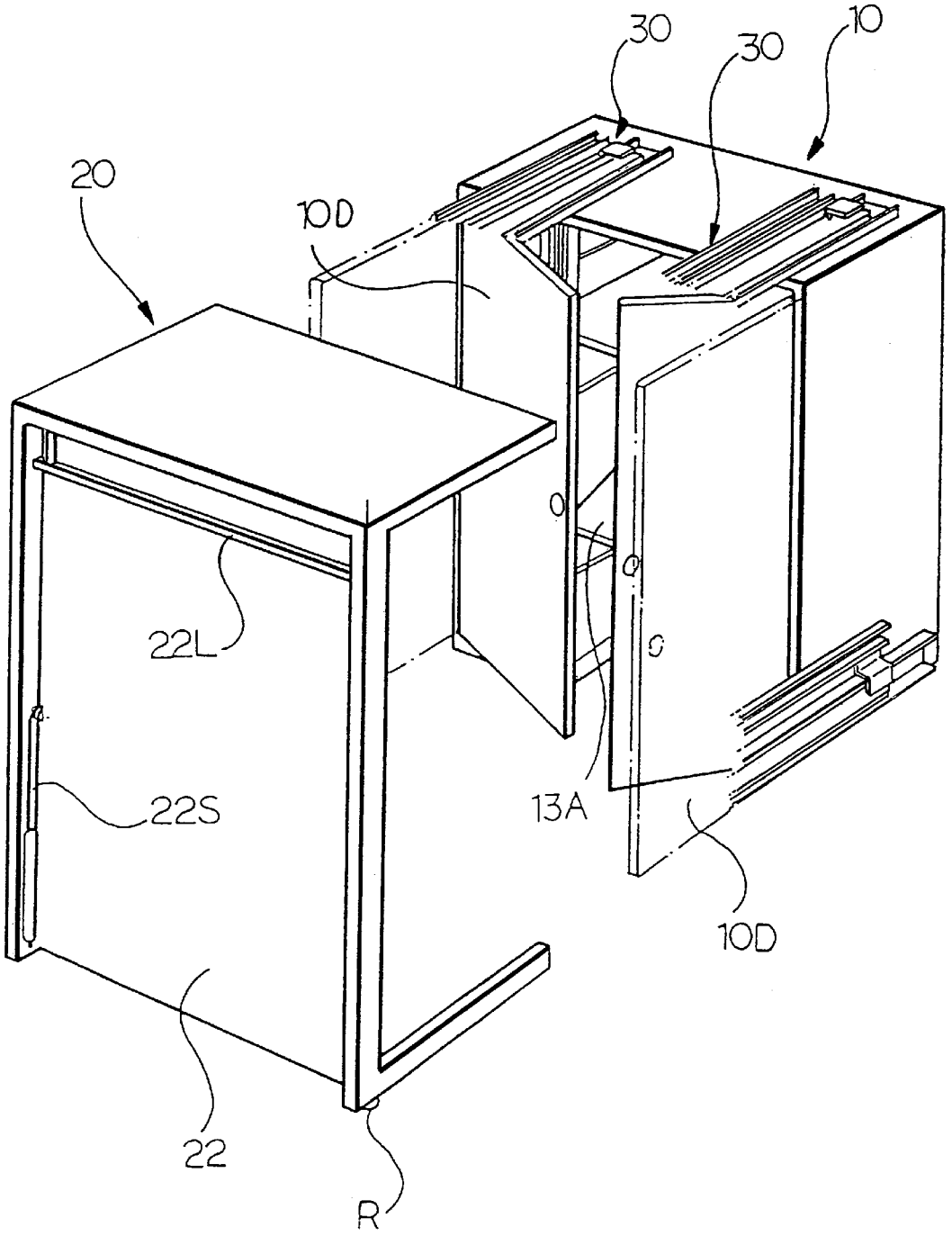
FIG. 6 is an exploded perspective view of an MPQ in accordance with another embodiment of the present invention, showing the slidable cover and body separated from each other.
Figure 9:
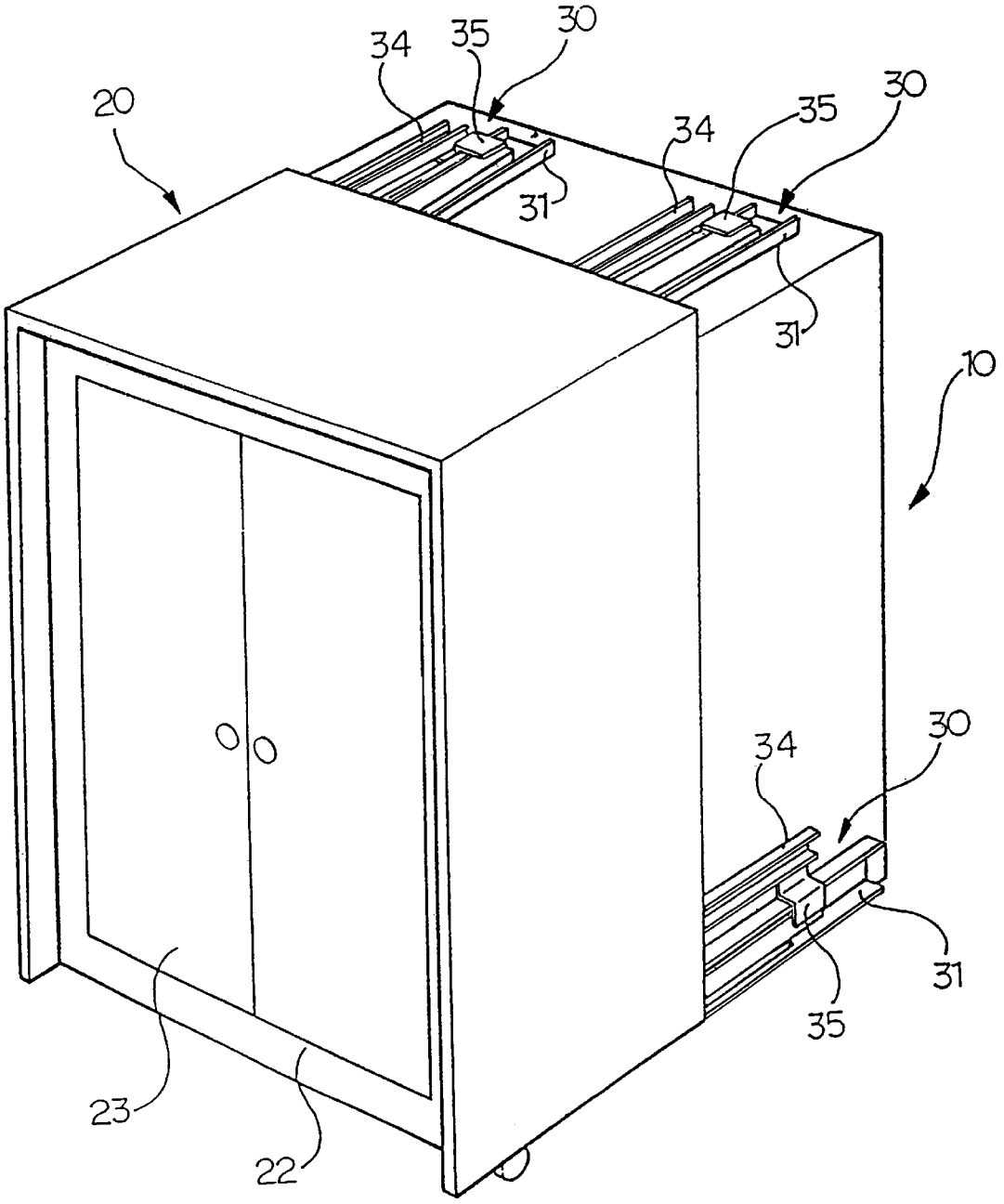
FIG. 9 is a perspective view of an MPQ according to yet another embodiment of the invention.

FIG. 6 shows an MPQ in accordance with another embodiment of the present invention. Therein, most of the elements of the MPQ remain the same as described for the MPQ of the primary embodiment of FIG. 1. However, the cover 20 of this embodiment is open at both sides, thereby becoming an open-type cover. In order to selectively close the open sides of the MPQ when it is in use, a pair of doors 10D that close the body 10, are opened at a 90° angle to both front side edges of the body 10. When using this embodiment, the doors 10D of the body 10 are opened after pulling the cover 20 away from the body 10, thereby closing both sides of the cover 20. When the MPQ is not used, the cover 20 is pushed over the body 10 after closing the doors 10D of the body 10, thereby achieving a compact closed configuration. In accordance with yet another embodiment of the present invention as shown in FIG. 9, an openable front door 23 is provided on the cover 20 in replacement of the bed.

Figure 8:
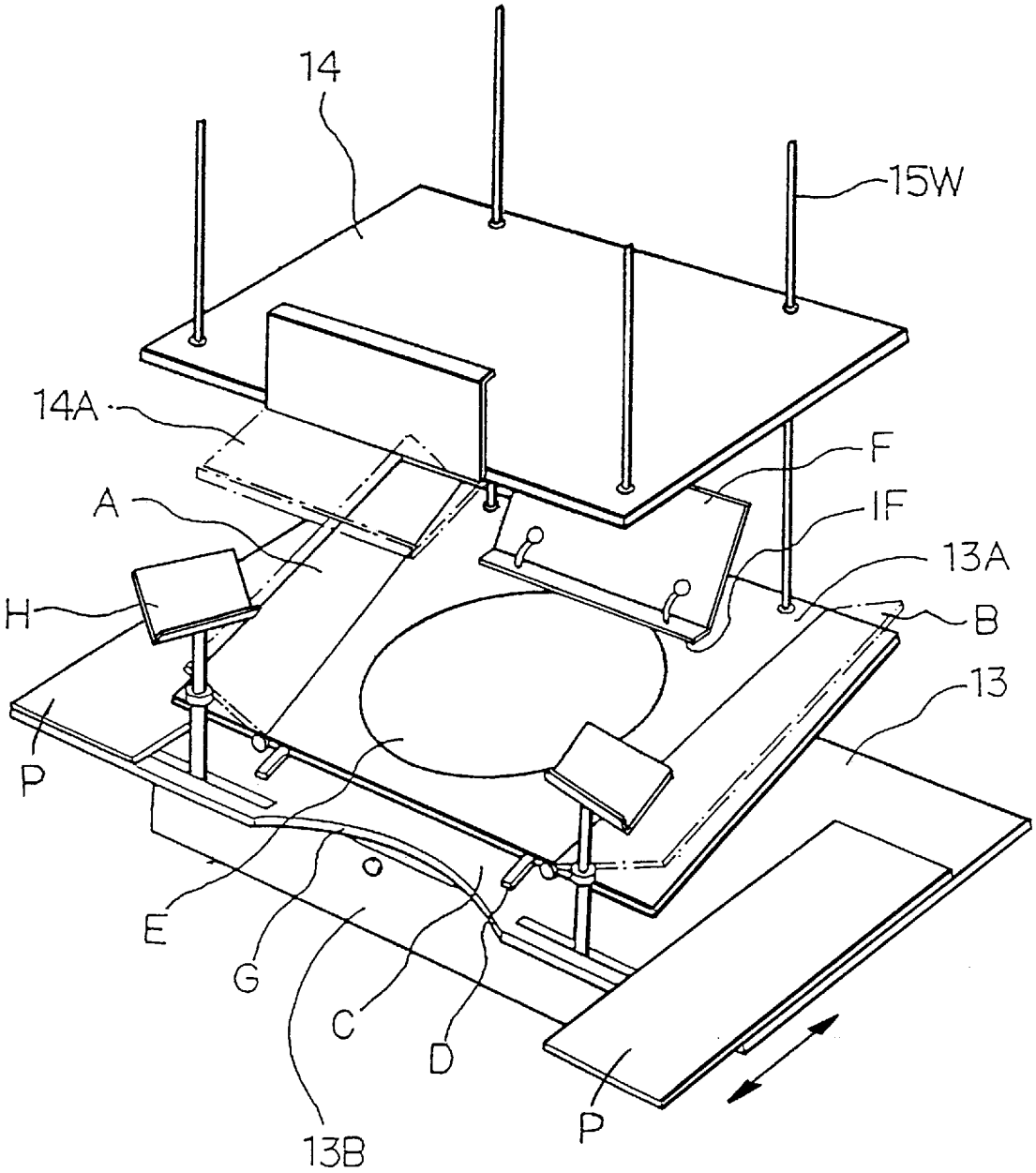
FIG. 8 is a perspective view showing the desk and holding panels of an MPQ in accordance with a further embodiment of the present invention.

In addition, as seen in FIG. 8 the inclined desk panel 13A is provided with movable side sections A and B, which pivot up or down, at both sides of a middle section. The side sections A and B of the panel 13A can be pivoted relative to the middle section within a predetermined angle. A drawer 13B is provided under the horizontal desk panel 13 and is used for storing the user's personal belongings. In order to form a storage space C between the horizontal and inclined desk panels 13 and 13A, a pair of rubber legs D of predetermined length extend from the front edge of the inclined panel 13A.

A turntable E is provided at the top center of the inclined panel 13A and selectively rotates an article placed thereon. The inclined desk panel 13A is also provided with an adjustable book holder F. The holder F, which is placed at the upper portion of the inclined panel 13A, can moves relative to the user, forward, backward, upward and downward. The front center of the horizontal desk panel 13 is partially cut away thereby forming an arcuate cutout G. The horizontal desk panel is further provided with pull-out panels D on either side for increased efficiency whereby the user may use them either as arm rests or as extra surface areas for books. These panels slide in and out on a system of sliders similar to those in FIG. 5. A dictionary holder H is provided at each front corner of the horizontal desk panel 13. The height of the dictionary holders H can be adjusted. In addition, the dictionary holders H can be turned to the left and right in order to adjust their position relative to the user.

In the MPQ, according to the present invention, the inclined desk panel 13A is held by the rear lifting wires 15W passing at the rear corners of the holding panel 14. The panel 13A may be provided with the rubber legs D extending from the front edge of the panel 13A as shown in FIG. 8. Alternatively, the front edge of the panel 13A may be pivoted to the front edge of the horizontal panel 13 as shown in FIG. 7. At the rear corners of the inclined panel 13A, the rear lifting wires 15W extending from both shafts 15S of the motor 15 and passing at the rear corners of the holding panel 14 are connected to the panel 13A using adjustable bosses 15Y respectively. Thereby, the inclination angle of the panel 13A relative to the horizontal panel 13 can be adjusted by the bosses 15Y. The inclined panel 13A is vertically moved along with the holding panel 14 by the rotational drive of the motor 15 transmitted thereto through the lifting wires 15W. The inclined panel 13A is preferably used as a drawing board.

In order to use a computer and its peripheral equipment on the panel 14 of the body 10, the user operates the control switch (not shown) to rotate the motor 15 in the normal direction. When the motor 15, in the state of FIG. 2A, rotates in the normal direction, the lifting wires 15W of the opposite shafts 15S of the motor 15 are unwound from the shafts 15S, thereby lowering both panels 13A and 14 under the guidance of the channeled columns 11. The front lifting wire 15W extending from each shaft 15S passes over the roller 15F prior to being connected to one front corner of the holding panel 14. Meanwhile, the rear lifting wire 15W extending from each shaft 15S extends vertically downwards from the shaft 15S to be connected to one rear corner of the holding panel 14. Each channeled column 11 may be provided with top and bottom limit switches (not shown) to limit the vertical movement of both panels 13A and 14. After using the computer, the panels 13A and 14 with the computer and its peripheral equipment are lifted by the reverse rotating force of the motor 15 and maintained in the upper section of the body 10.

As shown in FIG. 2C, the guide rollers 14R mounted at the bottom corners of the holding panel 14 are movably received in the channels 11*a* of the columns 11 respectively, thereby being guided by the columns 14 during the vertical movement of the panel 14 in the body 10. It should be noted that the designated space for panel 14 can be modified to include several panels of various sizes rather than the one large piece. Such panels would be operated by the same kind, but smaller, motors and pulleys similar to those used for panel 14. Furthermore, the holding panel 14 can be furnished with all or part of the amenities and accessories as horizontal panel 13 (e.g. inclined panel (13A), drawer (13B), dictionary holder (H), book holder (F), drawer (13B) and turntable (E). A keyboard holder 14A, shown in FIG. 8, is attached to the underside of panel 14, so that it can be slidably moved out when in use and pushed back under panel 14 when not in use. Alternatively, the keyboard holder 14A can be hinged to the front edge of the computer holding panel 14.

Of course, it will be understood that all the various embodiments of the MPQ will accommodate lighting and ventilating equipment, heating and cooling means, an audio speaker system, control switches, power receptacles, a folding mirror and locking means without affecting the function of this invention.

As described above, the present invention provides a multiple purpose quarters which generally comprises two parts, that is the body and the cover which are in slidable engagement with each other. The MPQ may be used as an isolated room for reading, computer operation, drafting, and studying. For musicians the MPQ, with its soundproofing, can double as a studio. When the MPQ is not in use, the cover is fully engaged over the body thereby achieving a compact configuration and saving space.

Although the preferred embodiments of the present invention have been disclosed for illustrative purposes, those skilled in the art will appreciate that various modifications, additions and substitutions are possible, without departing from the scope of spirit of the invention as defined in the accompanying claims:

What is claimed is:

1. A multi-purpose quarters comprising a box-shaped body (10) and a box-shaped cover (20) slidably engageable with said body (10) through sliding units (30) which provide movement of said body and said cover towards and away from one another, said body (10) and said cover (20) forming an isolated space therein when the cover (20) is moved away from said body (10), said cover (20) being provided with a pull-down bed (22) hinged thereto which forms a front wall of said cover (20) when said bed (22) is folded into the cover (20).

2. The multi-purpose quarters of claim 1, wherein said cover (20) is provided with a pair of doors (21) at both lateral sides thereof.

3. The multi-purpose quarters of claim 2, wherein said body (10) comprises a vertically movable holding panel (14) and means for vertically moving the holding panel (14).

4. The multi-purpose quarters of claim 3, wherein said means for vertically moving the holding panel (14) comprises:

a drive motor (15) supported in a rear top corner of said body (10);

said motor having shafts (15S) extending at both ends of said motor (15); and front and rear lifting wires (15W) extending downwards from said shafts (15S) for drivingly connecting said motor to said holding panel.

5. The multi-purpose quarters of claim 4, wherein said body (10) includes a horizontal desk panel (13) placed under said holding panel (14) and an inclined desk panel (13A) pivotably connected to said horizontal desk panel (13A) at a front edge of said horizontal desk panel, said inclined desk panel (13A) having rear corners connected to the lifting wires to move the inclined desk panel (13A) along with the holding panel (14).

6. The multi-purpose quarters of claim 1, wherein each of said sliding unit (30) includes:

a first longitudinal channeled guide (31) mounted on a surface of said body (10);

a second longitudinal channeled guide (32) mounted on an inner surface of said cover at a location corresponding to said first guide (31);

a retainer (33) having a plurality of sliding bearings engaging said first and second channeled guides; and a support (34) received within said first and second channeled guides (31, 32), said support (34) supporting said retainer.

7. The multi-purpose quarters of claim 1, wherein said cover has lateral sides which are open, said body (10) including doors (10D) hinged to said body to close the lateral sides of said cover when the doors (10D) are open to enclose said isolated space.

8. The multi-purpose quarters of claim 7, wherein said body (10) comprises a vertically movable holding panel (14) and means for vertically moving the holding panel (14).

9. The multi-purpose quarters of claim 8, wherein said means for vertically moving the holding panel (14) comprises:

a drive motor (15) located at a rear top corner of said body (10);

said motor having shafts (15S) extending at both ends of said motor (15); and front and rear lifting wires (15W) extending downwards from said shafts (15S) for drivingly connecting said motor to said holding panel.

10. The multi-purpose quarters of claim 9, wherein said body (10) includes a horizontal desk panel (13) placed under said holding panel (14) and an inclined desk panel (13A) pivotably connected to said horizontal desk panel (13A) at a front edge of said horizontal desk panel, said inclined desk panel (13A) having rear corners connected to the lifting wires to move the inclined desk panel (13A) along with the holding panel (14).

11. The multi-purpose quarters of claim 7 or 8 or 9 or 10, wherein each said slider unit (30) includes:

a first longitudinal channeled guide (31) mounted on a surface of said body (10);

a second longitudinal channeled guide (32) mounted on an inner surface of said cover at a location corresponding to said first guide (31);

a retainer (33) having a plurality of sliding bearings engaging said first and second channeled guides; and a support (34) received within said first and second channeled guides (31, 32), said support (34) supporting said retainer.

12. The multi-purpose quarters of claim 1, wherein said cover (20) is movable relative to said body (10) both automatically and manually.

13. The multi-purpose quarters of claim 5 or 10, wherein the holding panel (14) and the inclined desk panel (13A) are vertically movable both automatically and manually.

14. The multi-purpose quarters of claim 3 or 8, further comprising a computer keyboard holder (14A) attached to a front edge of said holding panel (14).

15. The multi-purpose quarters of claim 5 or 10, wherein said inclined desk panel (13A) comprises a middle section and a pair of wing sections hinged to said middle section.

16. The multi-purpose quarters of claim 5 or 10, further comprising a drawer (13B) under said horizontal desk panel (13).

17. The multi-purpose quarters of claim 5, comprising a turntable (E) on an upper center area of said inclined panel (13A).

18. The multi-purpose quarters of claim 10, comprising a turntable (E) on an upper center area of said inclined panel (13A).

19. The multi-purpose quarters of claim 17 or 18, further comprising an adjustable book holder (F) placed on an upper portion of said inclined desk panel (13A), said book holder (F) being movable relative to the inclined desk panel (13A).

20. The multi-purpose quarters of claim 17 or 18, further comprising at least one dictionary holder (H) at a front side of said horizontal desk panel (13), said dictionary holder (H) having a height and position which are adjustable.

21. The multi-purpose quarters of claim 17 or 18, wherein a front center portion of said horizontal desk panel (13) is partly cut away to form an arcuate cutout.

22. The multi-purpose quarters of claim 17 or 18, comprising pull-out panels at both sides of the horizontal panel (13).

23. The multi-purpose quarters of claim 1, wherein the body (10) is further provided with a number of holding panels (14) to divide the space within the body (10).

* * * * *